US007802677B2

(12) United States Patent
Williams

(10) Patent No.: US 7,802,677 B2
(45) Date of Patent: Sep. 28, 2010

(54) SELECTABLY LOCKABLE CASE

(75) Inventor: Ricky N. Williams, Pittsfield, MA (US)

(73) Assignee: MeadWestvaco Corporation, Richmond, VA (US)

( * ) Notice: Subject to any disclaimer, the term of this patent is extended or adjusted under 35 U.S.C. 154(b) by 74 days.

(21) Appl. No.: 11/969,616

(22) Filed: Jan. 4, 2008

(65) Prior Publication Data

US 2008/0290109 A1 Nov. 27, 2008

Related U.S. Application Data

(60) Provisional application No. 60/939,484, filed on May 22, 2007.

(51) Int. Cl.
*B65D 83/04* (2006.01)

(52) U.S. Cl. ..... 206/1.5; 206/531; 206/538

(58) Field of Classification Search ..... 206/1.5, 206/538, 462, 531, 807, 469; 220/345.3, 220/324, 326; 70/14, 57, 58, 63, 158, 163; 292/80, 81, 87, DIG. 37, DIG. 38, DIG. 63
See application file for complete search history.

(56) References Cited

U.S. PATENT DOCUMENTS

| | | | | |
|---|---|---|---|---|
| 3,387,699 | A | 6/1968 | Heller | |
| 4,120,400 | A | 10/1978 | Kotyuk | |
| 4,192,422 | A | 3/1980 | Kotyuk | |
| 5,019,125 | A | 5/1991 | Rebne et al. | |
| 5,275,291 | A | 1/1994 | Sledge | |
| 5,507,428 | A * | 4/1996 | Robinson et al. | 206/807 |
| 6,338,408 | B1 | 1/2002 | Anderson | |
| 6,349,831 | B1 | 2/2002 | Buss | |
| 6,640,693 | B2 | 11/2003 | Brezovnik et al. | |
| 6,719,133 | B2 * | 4/2004 | Perez et al. | 206/1.5 |
| 6,913,149 | B2 * | 7/2005 | Gelardi et al. | 206/1.5 |
| 2003/0006163 | A1 * | 1/2003 | Patterson | 206/531 |
| 2003/0062287 | A1 | 4/2003 | Gelardi et al. | |
| 2003/0102321 | A1 | 6/2003 | Maietta | |
| 2003/0209460 | A1 | 11/2003 | Bolnick et al. | |
| 2005/0183981 | A1 | 8/2005 | Gelardi | |

FOREIGN PATENT DOCUMENTS

| | | |
|---|---|---|
| DE | 40 01 645 A1 | 8/1991 |

(Continued)

OTHER PUBLICATIONS

U.S. Appl. No. 11/994,811, filed Jan. 4, 2008, Le, Thanhhung.

(Continued)

*Primary Examiner*—J. Gregory Pickett
*Assistant Examiner*—Andrew Perreault
(74) *Attorney, Agent, or Firm*—MWV Intellectual Property Group

(57) ABSTRACT

A lockable container includes a lockable case and an insert. The insert can be stored in the lockable case. The lockable case and the insert can each have one or more engaging elements and receiving elements, with reciprocal elements for engaging or receiving being included in the case or insert. The engaging elements, the receiving elements, or both, can be made removable to provide selective removal of the locking feature of the lockable container. For example, the engaging elements can be a removable post that can be selectively removed from the lockable case.

30 Claims, 5 Drawing Sheets

FOREIGN PATENT DOCUMENTS

| | | | |
|---|---|---|---|
| EP | 0547730 | A2 | 6/1993 |
| EP | 1 002 744 | A1 | 5/2000 |
| EP | 1277670 | B1 | 5/2005 |
| GB | 1279941 | A | 6/1972 |
| JP | 2000 062843 | | 2/2000 |
| WO | WO 2004/037657 | A2 | 5/2004 |
| WO | WO 2005/030606 | | 4/2005 |
| WO | WO 2005/068304 | A2 | 7/2005 |
| WO | WO 2007/101098 | | 9/2007 |

OTHER PUBLICATIONS

U.S. Appl. No. 11/969,100, filed Oct. 16, 2008, Gelardi, John A.
U.S. Appl. No. 11/969,146, filed Oct. 23, 2008, Gelardi, John A.

* cited by examiner

SELECTABLY LOCKABLE CASE

RELATED APPLICATION

This application claims priority to U.S. Provisional Patent Application No. 60/939,484, filed May 22, 2007, the entirety of which is hereby incorporated by reference.

TECHNICAL FIELD

The present disclosure relates generally to lockable packaging. More specifically, the present disclosure relates to selectively lockable mechanisms for use with a lockable case.

BACKGROUND

Child-resistant or lockable containers, wherein multiple movements are required to open the container, have many uses. One use for a lockable container is to control the dispensing of medicine and medicaments in the form of pills and tablets. For example, locking caps on medicine bottles are well known. The typical locking cap mechanism requires a coordinated alignment and tipping, or axial pressure, or inward radial squeezing while turning the cap to remove it from its container in order to access the medicaments.

By way of another example, medicines are packaged in convenient flat boxes, which are difficult to secure with child-resistant features. Many medicaments in the form of tablets are sold in blister packs—blisters formed on a sheet sealed by a barrier that is punctured when extracting a tablet from a blister. When a typical cardboard flat box holding one or more blister packs is opened the entire contents of the package is exposed, making all of the tablets immediately available. The dangers posed by children with access to a large quantity of tablets not intended for their consumption is self evident.

SUMMARY

The illustrated embodiments of the present disclosure are directed to a child-resistant lockable container for storage and dispensing of medications packaged with a slideable member that holds items, for example, a tray, a drawer with compartments, a blister card, a blister pack, or the like ("slideable card"). The slideable card is illustrated as a conventional blister package, but the slideable member can be a tray, a slideable package, or any other packaging, as is known to those skilled in the art. The lockable container is illustrated as a two-piece molded plastic container closed on three sides to form a void that receives the slideable card. The slideable card slideably translates through the open fourth side of the lockable container. Posts molded on one piece of the lockable container are connected, and in some embodiments sealed or welded, with the corresponding hollow cylinders molded on the other piece of the lockable container. Other attachment mechanisms can be used, and use of such other mechanisms is contemplated.

The lockable container can include one or more locking features. The locking features can include engagement mechanisms formed on one or both of the two pieces of the lockable container. The engagement mechanisms can include, for example, one or more posts, apertures, catches, lips, hooks, adhesives, metallic and/or magnetic surfaces, VELCRO® fasteners, or other mechanisms ("post"). When the slideable card is inserted into the container, the engagement mechanisms can engage receiving mechanisms formed on or in the slideable card. The receiving mechanisms can include, for example, one or more apertures, posts, catches, lips, hooks, adhesives, metallic and/or magnetic surfaces, VELCRO® fasteners, or other mechanisms ("aperture"). A release button is located on the lockable container, and is positioned proximate to the post. One or more ribs, springs, and/or other biasing mechanisms can be located proximate the engaging or receiving mechanisms to exert a compressive force upon, and thereby urge, the engaging mechanism to engage the receiving mechanism. Pressing the release button manipulates the slideable card to disengage the engaging and receiving mechanisms so that the slideable card can be slideably removed.

At times, it may be desirable to deactivate the locking features of the lockable container. Therefore, the lockable container is equipped with a lock deactivation feature, several embodiments of which are herein disclosed and described. The lock deactivation feature can be integrated into the lockable container. In one embodiment, the lock deactivation feature includes a frangible line formed in the lockable case that surrounds the engaging mechanism, the receiving mechanism, or both. When a user wants to deactivate the locking feature of the lockable container, the frangible line can be severed, and the engaging mechanism, the receiving mechanism, or both can be removed from the lockable case.

In another embodiment, the release button is connected to the engaging mechanism, the receiving mechanism, or both by a frangible line. The engaging mechanism, the receiving mechanism, or both can also be defined by a frangible line. Additionally, the hinge for the release button can be a frangible line. As such, a user can selectively remove the release button, the engaging mechanism, or both. Alternatively, the user can sever the frangible line between the release button and the engaging mechanism, the receiving mechanism, or both, to allow the container to function in much the same manner as the container briefly described above. Of course, a user can use the container with the locking feature and later decide to remove the locking feature, depending upon the user's needs at any given time.

Accordingly, a storing and dispensing system includes a case. The case can include a plurality of sides. One or more of the sides can include a first engagement mechanism. The first engagement mechanism can be surrounded, in part, or completely, by a moveable pad, the moveable pad being configured to permit movement of the first engagement mechanism.

According to an aspect of the disclosure, the case includes a slideable element. The plurality of sides are connected to form a void. The void is configured to receive the slideable element, and the case includes an opening proximate the void through which the slideable element can be at least partially passed.

According to another aspect of the disclosure, the case includes a release for selectively disengaging the first engagement mechanism from the second engagement mechanism.

According to another aspect of the disclosure, the one or more removable pads are configured to permit movement of the second engagement mechanism from a first position to a second position. The first position can be a position at which the second engagement mechanism can engage the first engagement mechanism. The second position can be a position at which the second engagement mechanism can not engage the first engagement mechanism.

According to another aspect of the disclosure, the second position includes removal of the moveable pad from the case.

According to another aspect of the disclosure, the release is at least partially defined by a surround and a hinge.

According to another aspect of the disclosure, the case further includes a first frangible line at least partially surrounding the second engagement mechanism to define the removable pad.

According to another aspect of the disclosure, the second engagement mechanism is a post.

According to another aspect of the disclosure, the release and the mechanism for engaging are detachably connected by a frangible line.

According to another aspect of the disclosure, the case can include a release slot proximate to the first frangible line.

According to another aspect of the disclosure, the surround is a frangible line.

According to another embodiment, a lockable case for a slideable element includes a first side connected to a second side. A first engagement mechanism can be included at one of the sides, the first engagement mechanism being configured to engage a second engagement mechanism located at the slideable element. The case can include a release for disengaging the first engagement mechanism from the second engagement mechanism, and one or more movable pads at least partially surrounding the first engagement mechanism. The movable pad can be configured to permit movement of the first engagement mechanism. The movement can include moving the first engagement mechanism out of a position at which the first engagement mechanism can engage the second engagement mechanism.

According to an aspect of the disclosure, the moveable pad is removable from the lockable case.

According to another aspect of the disclosure, the release is defined by a surround and a hinge.

According to another aspect of the disclosure, the case can also include a first frangible line at least partially encircling the first engagement mechanism. The frangible line can define, totally, or in part, the movable pad.

According to another embodiment of the disclosure, there is taught a method for selectively deactivating a locking feature of a lockable case. The lockable case can include an engagement mechanism and the engagement mechanism can be made removable. The engagement mechanism can be removed from the lockable case.

According to another embodiment of the disclosure, a case for storing and dispensing items can include an engagement mechanism attached to at least one of the plurality of sides. The case can include an area of weakness, at least partially surrounding the engagement mechanism. The area of weakness can be configured to permit the engagement mechanism to move between a first position and a second position.

According to an aspect of the disclosure, the plurality of sides includes a base and a top, and the first engagement mechanism extends from the top or the base.

According to another aspect of the disclosure, the first position is a position at which the second engagement mechanism can engage the first engagement mechanism. The second position is a position at which the second engagement mechanism can not engage the first engagement mechanism.

According to another aspect of the disclosure, the second position comprises removal of the movable pad from the case.

According to another aspect of the disclosure, the second position includes removal of the first engagement mechanism from the case.

According to another aspect of the disclosure, the case also includes a release slot integral to the frangible line.

According to another aspect of the disclosure, the case also includes a release slot proximate to the frangible line.

According to another aspect of the disclosure, the frangible line comprises one or more cuts, nicks, indentations, perforations, or combinations thereof.

According to another aspect of the disclosure, the frangible line and the release slot do not completely surround the first engagement mechanism.

According to another aspect of the disclosure, the frangible line completely surrounds the first engagement mechanism.

According to another aspect of the disclosure, the plurality of sides includes a base, wherein the first engagement mechanism is attached to the base, and a release button formed in the base and positioned proximate to the first engagement mechanism.

According to another aspect of the disclosure, the frangible line includes at least two ends, wherein the release button is formed at least partially by an aperture, and wherein at least one ends of the frangible line terminates at the aperture.

According to another aspect of the disclosure, the frangible line is not continuous.

According to another aspect of the disclosure, the release button is formed at least partially by an aperture, and the frangible line, the release slot, and the aperture completely surround the first engagement mechanism.

According to another aspect of the disclosure, the case also includes a slideable element with a second engagement mechanism, wherein the first engagement mechanism is operable to engage the second engagement mechanism when the slideable element is inserted into the case.

According to another embodiment, a method for selectively deactivating a locking feature includes the steps of accessing a lockable case including an internal engagement mechanism and an external release area, moving material proximate the release area and proximate the internal engagement mechanism, and causing the engagement mechanism to move from a first position to a second position.

According to an aspect of the disclosure, the step of causing also includes causing the engagement mechanism to move from a first position, at which the engagement mechanism is attached to the case, to a second position, at which the engagement mechanism is not attached to the case.

DESCRIPTION

As required, detailed embodiments of the present invention are disclosed herein. It must be understood that the disclosed embodiments are merely exemplary examples of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Figure 1:
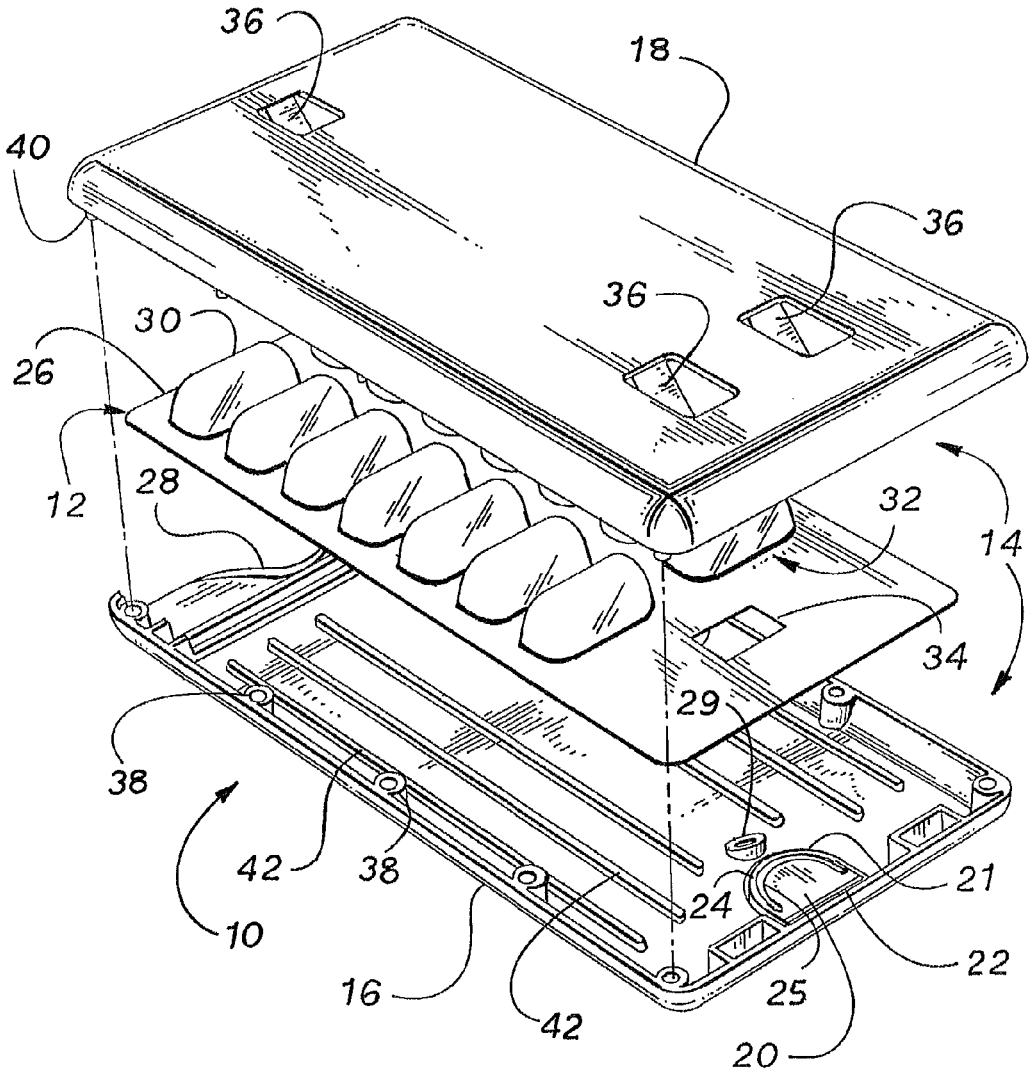
FIG. 1 is an exploded top perspective view of an exemplary lockable case for use with an embodiment of the present disclosure.
Figure 2:
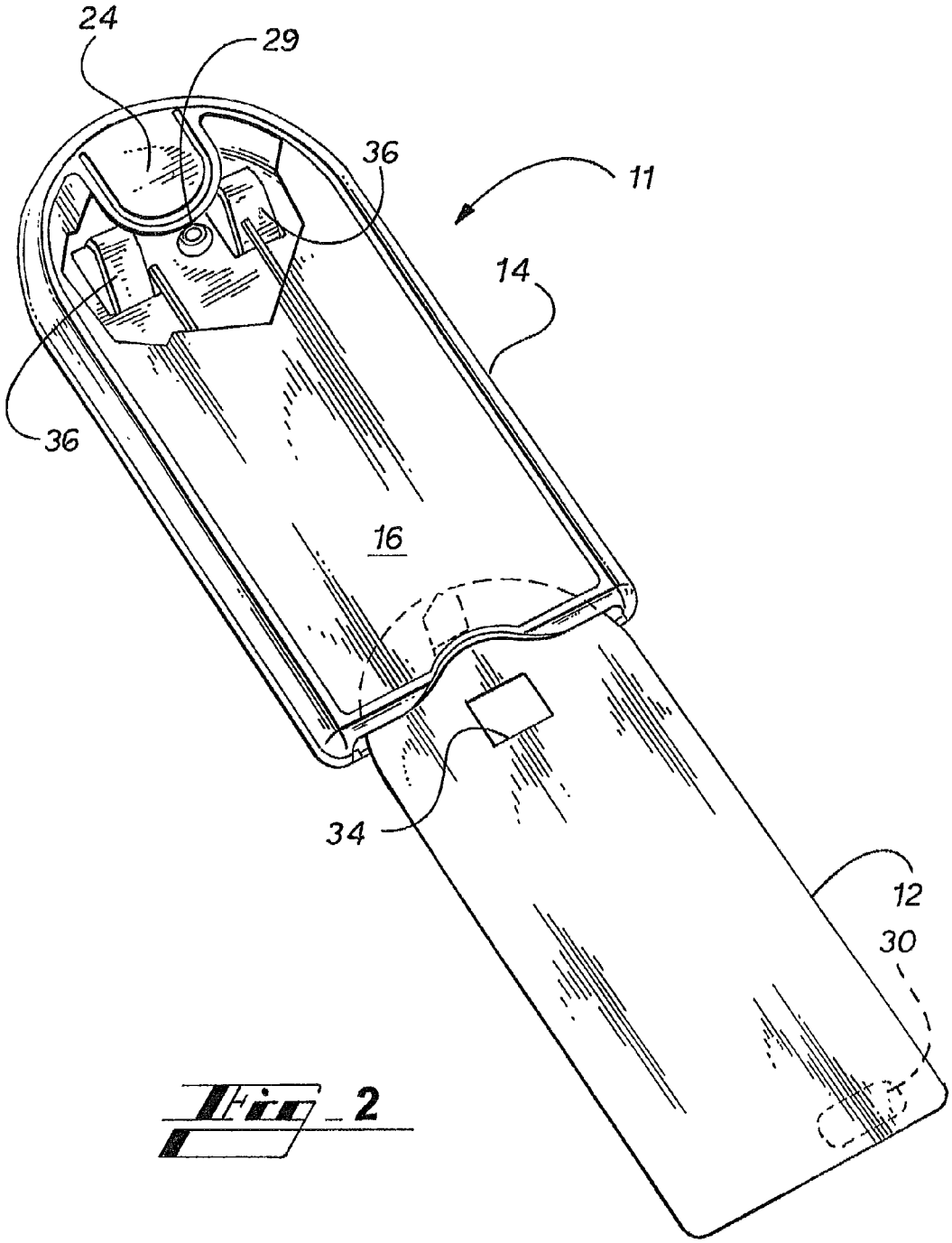
FIG. 2 is a top perspective transparent view of another exemplary lockable case for use with an embodiment of the present disclosure.

Referring now to the drawings wherein like numerals represent like features throughout, there are illustrated exemplary embodiments of the present disclosure. FIGS. 1-2 illustrate two exemplary embodiments of locking packages for use with the concepts of the present disclosure. While two embodiments are shown, it must be understood that there are many contemplated embodiments of locking packages with which embodiments of the present disclosure can be employed. This description is limited to discussing two exemplary embodiments for the sake of brevity.

FIG. 1 illustrates a perspective top exploded view of an exemplary locking package 10. A locking package 10 includes a slideable insert 12 ("insert") and a locking case 14. The locking case 14 can be made by assembling together a base 16 and a top 18. The locking case 14 can include at least one release button 20, formed at least partially by an aperture 21 in the base 16, the top 18, or both. The release button 20 can be integrally formed with and connected to the case 14 by a thin resilient hinge 22. The release button 20 can include a free end 24 that is defined by and surrounded at least partially by the aperture 21. The free end 24 therefore rotates about the hinge 22 and can be pushed into the case 14. Pushing on the free end 24 can free the insert 12. The inside of the release button 20 can include a rim 25 that engages the insert when the release button 20 is pushed into the case 14. As a force is applied to the insert 12 by the rim 25, the insert 12 can be withdrawn from the locking case 14, as will be explained below. The locking case can also include one or more locking posts 29. It should be appreciated that the posts 29 can be substituted for one or more apertures, catches, lips, hooks, adhesives, metallic and/or magnetic surfaces, VELCRO® fasteners, or any other engaging mechanism. The base 16 of the locking case 14 has a recess 28.

The insert 12 can be, for example, a blister pack, a tray, a drawer, a card, or the like. As illustrated in FIG. 1, the slideable insert 12 can include one or more product-containing blisters 30. In the illustrated embodiment, the blisters 30 are arranged in two columns 32. The insert 12 can have one or more apertures 34. It should be appreciated that the apertures 34 can be substituted for one or more posts, catches, lips, hooks, adhesives, metallic and/or magnetic surfaces, VELCRO® fasteners, or any other receiving mechanisms ("receiving mechanism"). The receiving mechanism 34 can interface with, and be engaged by, the engaging mechanism 29. In the illustrated embodiment of FIG. 1, the aperture 34 is positioned beyond the blisters 30 and cooperates with the locking post 29 to prevent movement or translation of the insert 12 until the release button 20 is pushed into the locking case 14. When the release button 20 is pushed, the rim 25 contacts the insert 12 and lifts at least the portion of the insert 12 that includes the aperture 34, out of engagement with the locking post 29. After the aperture 34 and the locking post 29 are disengaged, the insert 12 can be removed from the locking case 14. Reference numeral "26" denotes one of the opposed ends of the insert 12.

As illustrated in FIGS. 1 and 2, the locking case 14 can include biasing members 36, mechanical fasteners, chemical adhesives, or other attaching mechanisms 38, 40, ribs 42, and other features. As illustrated in FIG. 2, the locking case 14 and the insert 12 can have any desired configuration and need not be rectangular as illustrated in FIG. 1.

The illustrated embodiments and description presented above include the advantages of a lockable container 10. However, under certain condition the locking feature is not desired. For example, while a lockable container 10 holds medication in blister packs 12 there may not be children in the vicinity to access the lockable container 10. Alternatively, children may be in the vicinity of the lockable container 10 only during limited times. In these circumstances it may be desirable to deactivate the locking or child resistance features so that the user, presumably an adult who owns the lockable container 10 and its contents or for whom the contents are intended, can access the contents without repeatedly manipulating the child-resistant features.

Accordingly, the present disclosure includes structures and methods for selectively disabling the locking features of the lockable container 10. It should be understood that the concepts disclosed below are applicable to any lockable containers 10, and are not limited to the illustrated embodiments.

Figure 3:
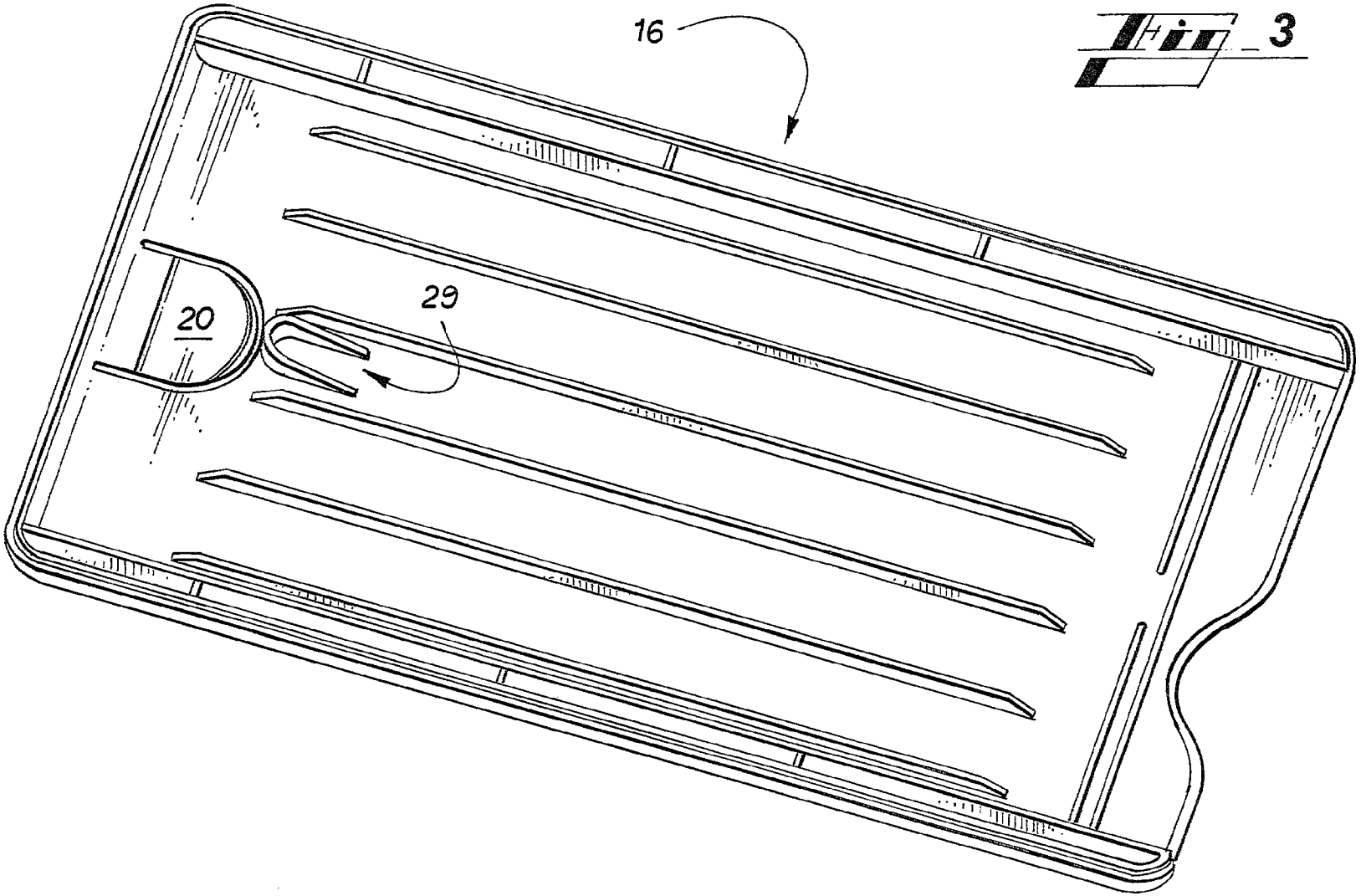
FIG. 3 is a perspective view of an exemplary deactivatable locking case base according to an embodiment of the present disclosure.

FIG. 3 illustrates a base 16 of a lockable case 10 according to an alternative embodiment of the present disclosure. The illustrated base 16 includes a release button 20 and a locking post 29. While the illustrated locking post 29 is ramped and in the general shape of a horseshoe, it should be understood that the locking post 29 can have any desired shape, including, but not limited to, being substantially cylindrical, as illustrated in FIGS. 1 and 2. According to the concepts of the present disclosure, one method of deactivating the locking features of a locking case 14 is to remove the engaging mechanism 29 from the locking case 14, thereby preventing the receiving mechanism 34 from being engaged, as explained above.

Figure 4:
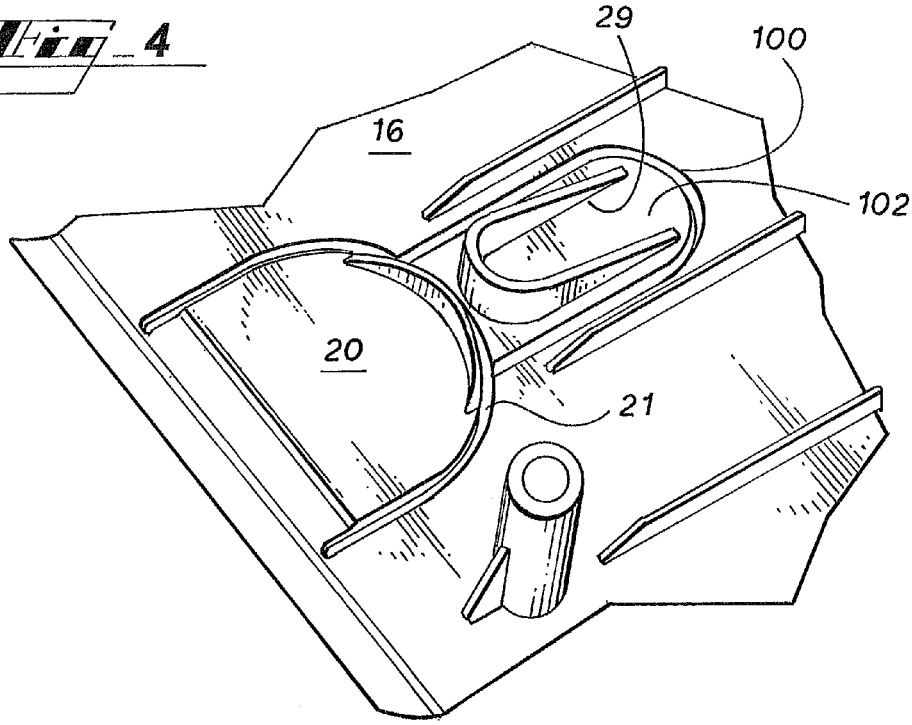
FIG. 4 is a perspective view of an exemplary removable locking post of the deactivatable locking case of FIG. 3.
Figure 5:
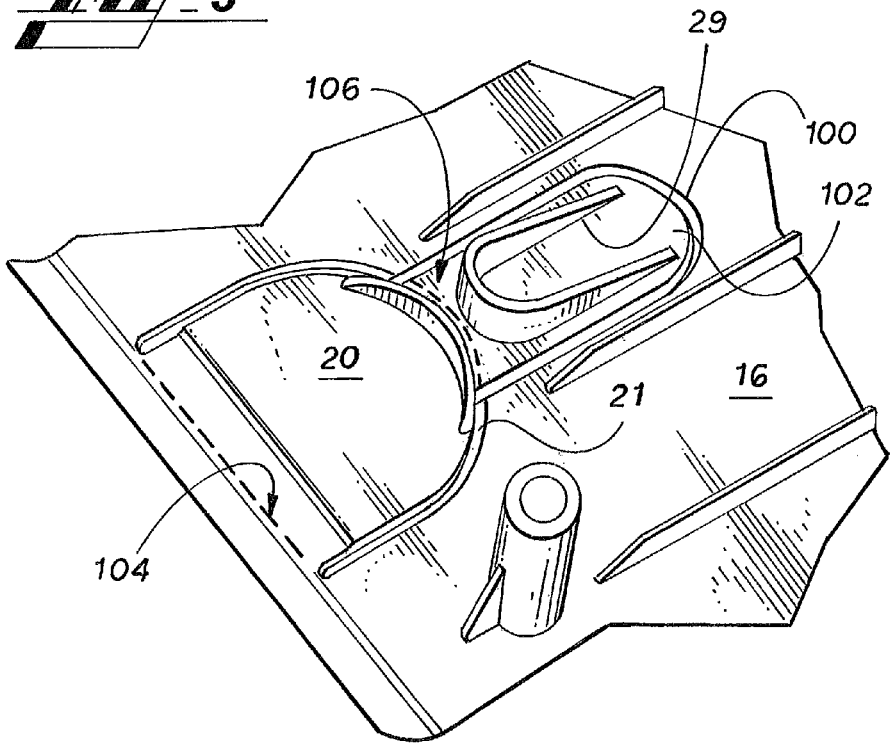
FIG. 5 is a perspective view of another exemplary removable locking post of a deactivatable locking case.

Referring additionally to FIGS. 4 and 5, two exemplary structures for creating a selectively deactivatable locking mechanism are illustrated. FIGS. 4 and 5 illustrate selectively removable locking posts 29, the removal of which selectively deactivate the locking feature of the locking case 14. In FIG. 4, a first frangible line 100 is illustrated as encircling the locking post 29.

In the illustrated embodiment of FIG. 4, the frangible line 100 is illustrated as beginning from the aperture 21, encircling the locking post 29, and then returning to the aperture 21, though this configuration is not required. The illustrated frangible line 100 is illustrated as an indentation or score in the locking case 14, but in alternative embodiments, the frangible line 100 may be any length or series of cuts, nicks, indentations, perforations, or combinations thereof and the like. For example, the frangible line 100 can be substantially circular and can completely encircle the locking post 29. If such a configuration is chosen, the locking post 29 can be completely removed from the locking case 14, thereby leaving a circular aperture in the locking case 14. Alternatively, the frangible line 100 can be more than one line, the severing of which can create a free end and a hinge as was explained above with reference to the release button 20 and hinge 22. As such, the locking post 29 can be rotated out of engagement without being removed from the locking case 14.

Irrespective of the exact configuration chosen for the frangible line 100, the locking post 29 is removable by breaking, tearing, or otherwise severing part or all of the locking post 29 from the surrounding material of the locking case 14. As illustrated in FIG. 4, the frangible line 100 can also define a locking post pad 102 that is removable with the locking post 29.

FIG. 5 illustrates yet another embodiment of providing a selectively deactivatable locking feature of a lockable case 14. In FIG. 5, the locking case 14 includes a release button 20 that can be defined by an aperture 21, a first frangible hinge 104, and a second frangible line 106. As illustrated, the release button 20 can be substantially connected to the locking post pad 102, the latter being defined by a frangible line 100. A user who desires to use the locking feature of the lockable container 10 can sever or otherwise separate the release button 20 from the locking post pad 102 along the second frangible line 106. After the release button 20 has been separated from the locking post pad 102, the locking container 10 functions in a manner similar to the function of the locking container illustrated in FIGS. 1 and 2.

If, on the other hand, the user of the locking container 10 does not need or desire to use the locking feature of the locking container 10, then the user can sever or otherwise separate the release button 20 from the surrounding material of the locking case 14 by severing the frangible hinge 104. After the release button 20 is severed from the surrounding material by severing the frangible hinge 104, the release button 20 can now operate as a tab. The user can pull the tab away from the locking case 14 to break the first frangible line 100, thereby allowing removal of the locking post pad 102 and the attached locking post 29.

In alternative embodiments, other methods and structures can be employed to allow removal of the locking post pad 102 and/or the locking post 29. For example, in lieu of, or in addition to the first frangible line 100, the material of the locking case 14 proximate the locking post pad 102 or the locking post 29 can be made of a thinner or more brittle material than other sections of the locking case 14 to allow easier removal of the locking post pad 102 and/or the locking post 29.

Figure 6:
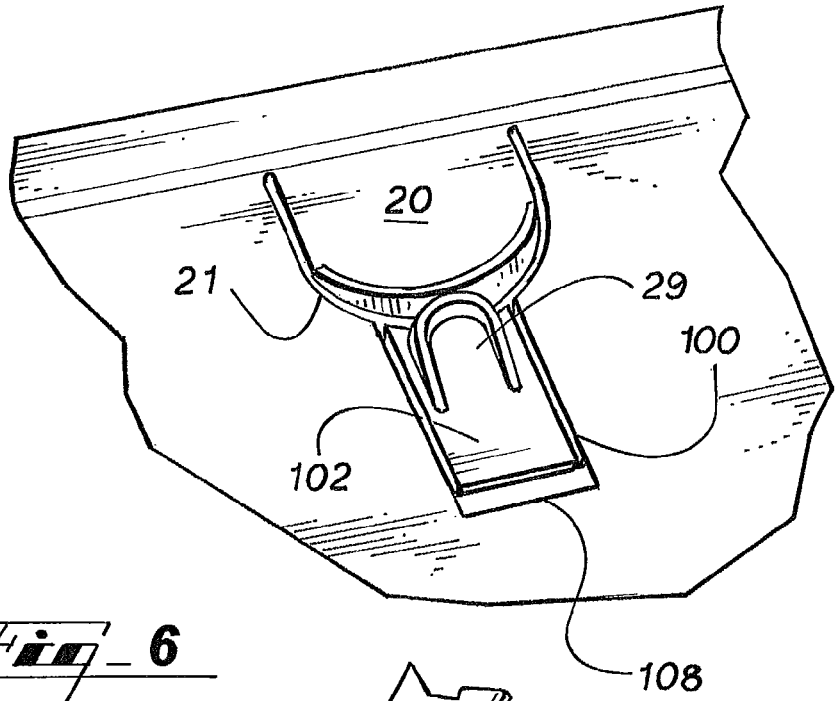
FIG. 6 is a perspective view of another exemplary removable locking post of a deactivatable locking case.
Figure 7:
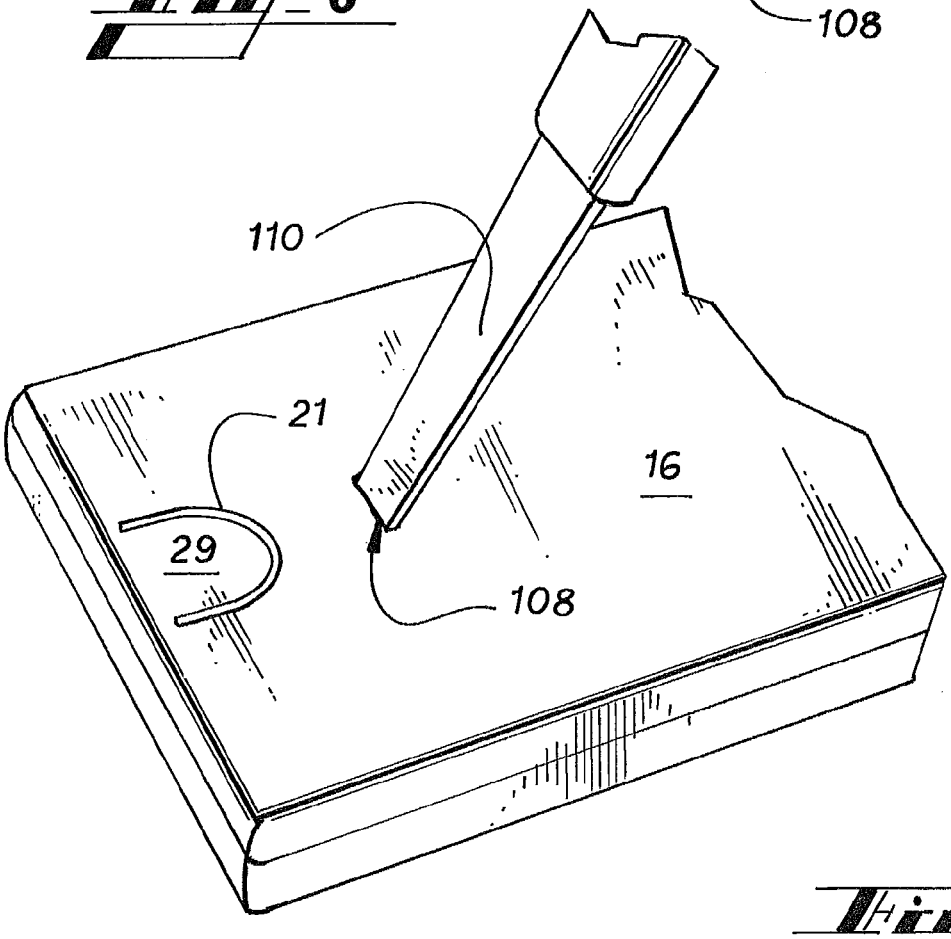
FIG. 7 illustrates a method of removing the exemplary removable locking post of FIG. 6, according to an exemplary embodiment of the present disclosure.

FIGS. 6 and 7 illustrate another structure for providing a selectively removable locking mechanism for a locking container 10. In FIGS. 6 and 7, the locking case 14 can include a release slot 108 integral or proximate to the first frangible line 100. To remove the locking post pad 102 and/or the locking post 29, a tool 110 can be inserted into the release slot 108. As illustrated in FIG. 7, the tool 110 can be used to pry some or all of the locking post pad 102 away from the surrounding material of the locking case 14.

While the illustrated embodiments of the locking case 14 include a base 16 and a top 18, it is contemplated that a locking case 14 can include two substantially similar panels. For example, it is contemplated that a multiple use locking case 14 can include a removable locking post pad 102 on each of the sides, thereby allowing the user to use the locking case 14 with the child resistance features of a second side after the child resistance features of a first side have been deactivated. In such embodiments, the user can selectively deactivate the child resistance features at least twice.

Similarly, another contemplated embodiment of the multiple use locking case 14 includes a moveable locking post pad that is substantially similar to the locking post pad 102. The moveable locking post pad can be substantially surrounded by a weakened, moveable, or frangible line or region of material. When the user wants to deactivate the child resistance features of the locking case 14, the moveable locking post pad can be moved, for example, along a hinge, or other similar feature, out of the locking case 14. As such, the engagement element, for example, a locking post 29, can be moved out of a position at which it will engage the insert 12. A tool can be inserted between the moveable locking post pad and the locking case 14, thereby maintaining the moveable locking post pad and the engagement mechanism in a disengaged orientation. When a user wants to reactivate the child resistance features of the case, the tool can be removed, and the moveable locking post pad and the engagement mechanism can be returned to the engagement position.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A storing and dispensing system, comprising:

a case comprising:

a plurality of sides connected to define a void;

one or more removable pads formed in at least one of the plurality of sides;

a first engagement mechanism attached to at least one of the one or more removable pads; and a slideable element configured to be at least partially inserted into the void, the slideable element comprises a second engagement mechanism for engaging the first engagement mechanism, the first engagement mechanism comprises one of a decent and a receiving element, the second engagement mechanism comprises the other of the detent and the receiving element;

wherein the case further comprises a release button for selectively disengaging the second engagement mechanism from the first engagement mechanism, the release button being defined at least in part by a release aperture in the at least one of the sides and connected to the at least one of the sides, wherein the one or more removable pads are removably connected to the at least one of the sides by a first frangible line to permit removal of the first engagement mechanism from the case, the frangible line extending substantially from the release aperture such that the one or more removable pads are disposed adjacent to the release button.

2. The system of claim 1, wherein the case further comprises an opening proximate the void through which a slideable element may be at least partially passed.

3. The system of claim 1, wherein the release button and the one or more removable pads are detachably connected by a second frangible line.

4. The system of claim 1, wherein the at least one of the sides comprises a release slot for receiving a tool to facilitate removal of the first engagement mechanism, the release slot being disposed proximate to the first frangible line.

5. A lockable case for a slideable element comprising:

a first side connected to a second side;

a detent at one of the sides operable to engage an engaging aperture located at a slideable element;

a release button for disengaging the detent from the engaging aperture, the release button being defined at least in part by a release aperture in the one of the sides and connected to the one of the sides by a hinge, the release button extending from the hinge to a free end; and a frangible line formed on the one of the sides and extending substantially from the free end of the release button to be disposed on opposite sides of the detent to permit removal of the detent from the one of the sides.

6. The case of claim 5, wherein the frangible line is disposed to at least partially define a removable pad to which the detent is attached, the removable pad being removably connected to the one of the sides along the frangible line.

7. A combination comprising a case and a slideable element slideably received in the case, wherein the case includes:

a plurality of sides;

a first engagement mechanism attached to at least one of a plurality of sides; and a frangible line at least partially surrounding the first engagement mechanism, the frangible line being configured to define a removable portion of the at least one of the sides to permit the first engagement mechanism to be removed from the at least one of the sides along with the removable portion, wherein the slideable element includes a second engagement mechanism for engaging the first engagement mechanism to lock the slideable element in the case, the first engagement mechanism comprising one of a detent and a receiving element, the second engagement mechanism comprising the other of the decent and the receiving element, wherein the case further includes a release button for disengaging the first engagement mechanism from the second engagement mechanism, the release button being defined at least in part by a release aperture in the at least one of the sides, the frangible line extending substantially from the release aperture such that the removable portion is disposed adjacent to the release button.

8. The combination of claim 7, wherein the sides includes a base and a top, and wherein the first engagement mechanism comprises the detent that extends from the removable portion defined in one of the top and the base toward the other.

9. The combination of claim 8, the frangible line comprises a slot for receiving a tool to facilitate removal of the detent, the slot being disposed such that the removable portion is disposed between the slot and the release button.

10. The combination of claim 9, wherein the frangible line further comprises two spaced frangible line segments each extending between the release aperture and the slot.

11. The combination of claim 10, wherein the removable portion is defined by the two spaced frangible line segments and the slot and further by a portion of the release aperture.

12. The system of claim 1, wherein the detent comprises a post projecting from a respective one of the slidable element and the one or more removable pads, and wherein the receiving element comprises a receiving aperture defined in the other of the slidable element and the one or more removable pads.

13. The system of claim 12, wherein the post projects from the one or more removable pads into the void and wherein the receiving aperture is defined in the slidable element.

14. The system of claim 2, wherein the frangible line comprises two spaced frangible line segments extending substantially from the release aperture toward the opening to define the one or more removable pads and wherein the first engagement mechanism is disposed between the two frangible line segments.

15. The system of claim 14, wherein the frangible line further comprises a slot for receiving a tool to facilitate removal of the first engagement mechanism from the case, the slot extending between the two frangible line segments such that the one or more removable pads are defined at least in part by the two frangible line segments and the slot.

16. The system of claim 15, wherein the one or more removable pads are further defined by a part of the release aperture such that the one or more removable pads are separated from the release button by the part of the release aperture.

17. The system of claim 16, wherein the part of the release aperture defines a free end of the release button, the release button having a proximal end opposite the free end thereof, the release button being connected at the proximal end to the at least one of the sides.

18. The system of claim 15, wherein the first engagement mechanism is disposed between the slot and the release button.

19. The system of claim 14, wherein the frangible line is generally U-shaped to substantially surround the first engagement mechanism.

20. The system of claim 14, wherein the one or more removable pads comprise a single pad having a pair of opposed side edges and a pair of opposed end edges, the side edges being defined by the two frangible line segments, one of the end edges being defined by part of the release aperture, the other end edge being defined by a slot extending between the two frangible line segments.

21. The system of claim 1, wherein the one or more removable pads extend from the release aperture to a slot defined in the at least one of the sides, and the first engagement mechanism is disposed between the release aperture and the slot.

22. The system of claim 21, wherein the frangible line comprises a pair of spaced frangible line segments each extending between the release aperture and the slot.

23. The combination of claim 8, wherein the detent comprises a post projecting from the removable portion, and wherein the receiving element comprises a receiving aperture defined in the slidable element.

24. The combination of claim 23, wherein the frangible line comprises two spaced frangible line segments extending substantially from the release aperture to define the removable portion of the one of the top and the base and wherein the detent is disposed between the two frangible line segments.

25. The combination of claim 24, wherein the frangible line further comprises a slot for receiving a tool to facilitate removal of the first engagement mechanism from the case, the slot extending between the two frangible line segments such that the removable portion of the one of the top and the base is defined at least in part by the two frangible line segments and the slot.

26. The combination of claim 25, wherein the removable portion of the one of the top and the base is further defined by a part of the release aperture such that the removable portion is separated from the release button by the part of the release aperture.

27. The combination of claim 26, wherein the part of the release aperture defines a free end of the release button, the release button having a proximal end opposite the free end thereof, the release button being connected at the proximal end to the one of the top and the base.

28. The combination of claim 24, wherein the removable portion comprises has a pair of opposed side edges and a pair of opposed end edges, the side edges being defined by the two frangible line segments, one of the end edges being defined by part of the release aperture, the other end edge being defined by a slot extending between the two frangible line segments.

29. The combination of claim 8, wherein the removable portion of the one of the top and the base extend from the release aperture to a slot defined in the one of the top and the base, and the detent is disposed between the release aperture and the slot.

30. The combination of claim 29, wherein the frangible line comprises a pair of spaced frangible line segments each extending between the release aperture and the slot.

* * * * *